US010340080B2

(12) United States Patent
Uozumi et al.

(10) Patent No.: US 10,340,080 B2
(45) Date of Patent: Jul. 2, 2019

(54) METHOD OF MANUFACTURING A GREEN COMPACT

(71) Applicants: Sumitomo Electric Industries, Ltd., Osaka (JP); Sumitomo Electric Sintered Alloy, Ltd., Okayama (JP)

(72) Inventors: Masato Uozumi, Itami (JP); Atsushi Sato, Itami (JP); Kazushi Kusawake, Itami (JP)

(73) Assignees: SUMITOMO ELECTRIC INDUSTRIES, LTD., Osaka (JP); SUMITOMO ELECTRIC SINTERED ALLOY, LTD., Okayama (JP)

( * ) Notice: Subject to any disclaimer, the term of this patent is extended or adjusted under 35 U.S.C. 154(b) by 0 days.

(21) Appl. No.: 15/339,255

(22) Filed: Oct. 31, 2016

(65) Prior Publication Data

US 2017/0069423 A1 Mar. 9, 2017

Related U.S. Application Data

(62) Division of application No. 13/583,357, filed as application No. PCT/JP2012/053688 on Feb. 16, 2012, now abandoned.

(30) Foreign Application Priority Data

Mar. 9, 2011 (JP) ..... 2011-052248

(51) Int. Cl.
*B22F 3/02* (2006.01)
*B22F 3/03* (2006.01)
(Continued)

(52) U.S. Cl.
CPC ..... *H01F 41/0246* (2013.01); *B22F 1/02* (2013.01); *B22F 3/03* (2013.01); *H01F 3/08* (2013.01);
(Continued)

(58) Field of Classification Search
CPC ..... B28B 3/06; B28B 3/08
See application file for complete search history.

(56) References Cited

U.S. PATENT DOCUMENTS 3,664,784 A * 5/1972 Sibley ..... B28B 3/08 425/107
3,980,413 A * 9/1976 Kononenko ..... B30B 1/001 249/67
(Continued)

FOREIGN PATENT DOCUMENTS

CN 1082245 A 2/1994
CN 1309005 A 8/2001
(Continued)

OTHER PUBLICATIONS

JP 2000-52328 machine translation (Year: 2000).*
(Continued)

*Primary Examiner* — Paul A Wartalowicz
*Assistant Examiner* — Stephani Hill
(74) *Attorney, Agent, or Firm* — Ditthavong & Steiner, P.C.

(57) ABSTRACT

The invention is directed to a method of manufacturing a green compact. The method includes a filling step of filling a compacting space with an insulated coated soft magnetic powder. The compacting space is defined by a die. The die has a through hole with which a part of the outer circumferential surface of the green compact is molded. The die also has a core rod with which another part of the outer circumferential surface of the green compact is molded, and a first punch disposed so as to cover one of opening portions of the through hole, the core rod being inserted and disposed in a space of the through hole. The method also includes a
(Continued)

pressurizing step using the first punch and a second punch disposed so as to face the first punch. The method also includes a removing step.

4 Claims, 6 Drawing Sheets

(51) Int. Cl.
*H01F 41/02* (2006.01)
*B22F 1/02* (2006.01)
*H01F 3/08* (2006.01)

(52) U.S. Cl.
CPC ..... *B22F 2998/10* (2013.01); *C22C 2202/02* (2013.01)

(56) References Cited

U.S. PATENT DOCUMENTS

| | | | | |
|---|---|---|---|---|
| 6,080,358 | A * | 6/2000 | Oba | B22F 5/10 419/38 |
| 2001/0041146 | A1 | 11/2001 | Ogawa | |
| 2003/0230362 | A1 | 12/2003 | Tajima et al. | |
| 2004/0238796 | A1* | 12/2004 | Abe | B22F 1/02 252/500 |
| 2013/0336832 | A1 | 12/2013 | Sugiyama et al. | |

FOREIGN PATENT DOCUMENTS

| | | | | |
|---|---|---|---|---|
| EP | 1353341 | A1 | | 10/2003 |
| JP | 2000052328 | A | * | 2/2000 |
| JP | 2000052328 | A | | 2/2000 |
| JP | 2005248274 | A | | 9/2005 |
| JP | 2006229203 | A | | 8/2006 |
| JP | 2008272774 | A | | 11/2008 |
| JP | 2010087240 | A | | 4/2010 |
| JP | 2011181654 | A | | 9/2011 |
| JP | 2013201394 | A | * | 10/2013 |
| WO | 2009115916 | A1 | | 9/2009 |

OTHER PUBLICATIONS

Upadhyaya. "5 Metal Powder Compaction." Powder Metallurgy Technology. Cambridge International Science Publishing. 1996. pp. 42-67. (Year: 1996).*

JP 2013-201394 machine translation (Year: 2013).*

Chinese Office Action for related Chinese Patent Application No. 201280000853.4, dated Dec. 25, 2013, 13 Pages.

Extended European Search Report for corresponding European Patent Application No. 12726705.2, dated Apr. 11, 2014, 8 Pages.

International Search Report for PCT Application No. PCT/JP2012/053688, dated Apr. 3, 2012, 1 Page.

Notification of the First Office Action for corresponding Chinese Patent Application No. 201280000853.4, dated Dec. 25, 2013, 13 Pages.

* cited by examiner

METHOD OF MANUFACTURING A GREEN COMPACT

RELATED APPLICATIONS

This application is a Divisional of U.S. application Ser. No. 13/583,357, filed on Sep. 7, 2012, which is a Nation Stage Entry of PCT/JP2012/053688, filed on Feb. 16, 2012 and claims priority of Japanese Patent Application 2011-052248, filed on Mar. 9, 2011, which are incorporated by reference herewith.

TECHNICAL FIELD

The present invention relates to a green compact used as a material of a core for a reactor or the like, a method of manufacturing the same, and a core for a reactor including the green compact. Particularly, the present invention relates to a green compact from which a low-loss core can be obtained, and a method of manufacturing the green compact.

BACKGROUND ART

Magnetic parts, each including a core made of a soft magnetic material such as iron or an alloy of iron and a coil placed around the core, have been utilized in various fields. A dust core made of a green compact is an example of the above core (see PTL 1). The green compact is typically manufactured by filling a compacting space, which is defined by a die having a through hole and a lower punch disposed so as to cover one opening portion of the through hole of the die, with a raw-material powder, pressurizing the raw-material powder using the lower punch and an upper punch, and then removing the green compact from the die. A thermally-treated material, which is obtained by subjecting the green compact to a thermal treatment, is normally utilized as a core.

In the case where the magnetic parts are used in an alternating-current magnetic field, a core having a low iron loss (approximately the sum of hysteresis loss and eddy current loss) is desired. Particularly, since high eddy current loss occurs in a core that is used at high frequencies, such as several kHz or higher, it is desirable that the core having reduced eddy current loss. As described in Patent Literature 1, if a coated soft magnetic powder, which is constituted by coated particles each obtained by coating an outer circumference of a metal particle, made of a soft magnetic material such as an iron particle, with an insulating coated film (insulating layer), is adopted as a raw-material powder, the electrical resistance of a green compact can be increased with the metal particles being insulated from each other. Thus, if this green compact is adopted as a core, a low-loss core that can effectively reduce eddy current loss can be obtained.

CITATION LIST

Patent Literature

PTL 1: Japanese Unexamined Patent Application Publication No. 2005-248274

SUMMARY OF INVENTION

Technical Problem

It is desired to further reduce loss in a dust core.

Since operation frequencies of magnetic parts are increasingly being made higher these days, it has been desired to further reduce loss, particularly, eddy current loss.

As described above, eddy current loss can be reduced to some extent by using a coated soft magnetic powder. However, when a green compact (compact body) is removed from a die, the metal particles of the green compact lying in an area that is in contact with the die are likely to be plastically deformed by rubbing against the die due to a reaction force against a force of the die with which the die presses the green compact, and the insulating layer may be damaged by failing to sufficiently follow the deformation. If some of the metal particles that have been exposed due to the insulating layer becoming damaged are deformed into a chip form by rubbing against the die, and if the metal particles come into contact with each other and become electrically conductive due to the deformation, an eddy current flows through the conductive portion and thus eddy current loss increases. In order to prevent the insulating layer from being damaged, as described in PTL 1, it is conceivable to apply a lubricant to the die or the lower punch or to add an organic compound, which functions as a lubricant, to a raw-material powder. The use of a sufficient amount of lubricant should fully prevent the insulating layer from being damaged. However, the use of a large amount of lubricant leads to a reduction of a magnetic component proportion of the green compact.

On the other hand, it is conceivable to perform a surface treatment on a surface of the green compact with a concentrated hydrochloric acid or the like to remove the conductive portion. In this case, however, a surface treatment step is separately required, which leads to a reduction in the productivity of the green compact.

In view of the above, an object of the present invention is to provide a green compact and a core for a reactor from which a low-loss core can be obtained. Another object of the present invention is to provide a method of manufacturing a green compact with which a low-loss core can be manufactured.

Solution to Problem

The inventors have found that, if a part of a green compact (compact body) does not come into contact with a die when the green compact is removed from the die, the part does not rub against the die, and thus an insulating layer can be prevented from being damaged and a green compact that has an area including a complete insulating layer (referred to as a complete area, below) can be obtained. Upon examination of the surface properties of an outer surface of the obtained green compact, the inventors have found that a complete area that is not molded with the die has a different roughness from an area molded with the die and the complete area has larger projections and depressions than the area molded with the die. This is probably because, in the area molded with the die, coated particles (soft magnetic particles) constituting the above-described coated soft magnetic powder are plastically deformed so as to become relatively flat by rubbing against the die when being removed from the die, while in the complete area, the soft magnetic particles remain without being plastically deformed excessively and have projections and depressions corresponding to their size.

Further, the inventors have found that eddy current loss can be reduced in the case where an outer surface of the green compact has a complete area in a part thereof, particularly in a portion of an outer circumferential surface that extends in a circumferential direction, such that the complete area intersects the outer circumferential surface in the circumferential direction. This is probably because the complete area can intersect an eddy current which occurs on the outer circumferential surface of the green compact since the complete area is an insulating area in which the soft magnetic particles are insulated from each other by the complete insulating layers.

On the basis of the above-described findings, the inventors introduce a green compact that has areas having different surface properties on an outer surface of the green compact as a green compact from which a low-loss core can be obtained. Further, on the basis of the above-described findings, the inventors introduce a specific configuration for a compacting space and a specific method of removing a green compact for manufacturing the green compact.

A green compact according to the present invention is a green compact obtained by pressurizing a coated soft magnetic powder including an insulating layer. The green compact satisfies a condition (1) or (2) when one surface of the green compact is taken as a reference surface, an area selected from the reference surface is taken as a reference area, and a surface property value in the reference area is taken as R1. The condition (1) is one in which the reference surface includes a same-plane surface area in which the ratio of a surface property value R2 to the surface property value R1 satisfies $R2/R1 \geq 2$ when an area selected from the reference surface other than the reference area is defined as the same-plane surface area and a surface property value in the same-plane surface area is defined as the surface property value R2. The condition (2) is one in which three or more surfaces each including a separate-plane surface area, in which the ratio of a surface property value R3 to the surface property value R1 satisfies $R3/R1 \geq 2$, are adjacent to the reference surface when an area selected from a surface that is different from the reference surface is defined as the separate-plane surface area and a surface property value in the separate-plane surface area is defined as the surface property value R3. The surface property values are all any or one of an arithmetic mean roughness Ra, a maximum height Rz, and a maximum valley depth Rv of a roughness curve.

The green compact according to the present invention can be manufactured by, for example, the following manufacturing method. A method of manufacturing a green compact is one with which a green compact is manufactured by filling a compacting space with a coated soft magnetic powder including an insulating layer and then by pressurizing the coated soft magnetic powder. One of characteristics of the method is to define a part of the compacting space by a plurality of die members, the part corresponding to a portion of an outer circumferential surface of the green compact that is to be formed. Another characteristic of the method is to remove a green compact, which has been obtained after pressurizing the coated soft magnetic powder, from the compacting space by moving at least one of the die members with respect to the formed green compact without moving the other die members with respect to the formed green compact.

The green compact according to the present invention has an outer surface that includes a rougher area (which is a same-plane surface area when the condition (1) is satisfied, or the entirety of a surface including a separate-plane surface area when the condition (2) is satisfied) and a less rough area (which is a part of a reference surface when the condition (1) is satisfied, or the reference surface when the condition (2) is satisfied), the rougher area and the less rough area being adjacent to each other. The rougher area can be considered to be a complete area in which an insulating layer is in a complete state, i.e., an insulating area, while the less rough area can be considered to be a flat area in which coated particles (soft magnetic particles) constituting the coated soft magnetic powder are deformed and thus projections and depressions are reduced in size. When the green compact according to the present invention including the complete area is used as a core, the complete area can intersect an eddy current and thus eddy current loss can be reduced even though some soft magnetic particles have become conductive in the flat area. Thus, a low-loss core can be formed from the green compact according to the present invention.

In the manufacturing method according to the present invention, particularly, when a solid green compact having a pillar-like shape or another shape and having no through hole, that is, a green compact having a contour that is drawn by one continuous outline is manufactured, multiple die members are used to form an outer circumferential surface (at least one surface that extends in the circumferential direction) of the green compact, not a single die member as in the existing techniques. With this configuration, at least one of the die members can be kept stationary with respect to the green compact (compact body) when the green compact is removed from the compacting space. When the green compact and the at least one die member are completely separated from each other, the green compact and the die member can be separated without a part of the outer circumferential surface of the green compact rubbing against the at least one die member since the other part of the outer circumferential surface of the green compact has been released from another die member. Consequently, on an outer circumferential surface, which is constituted by at least one surface that extends in the circumferential direction, of the green compact obtained by the manufacturing method according to the present invention, an insulating layer in an area molded with the at least one die member has substantially no damage caused by being rubbed against the die member, and thus is in a complete state. In short, the green compact includes an area including a complete insulating layer, extending in the circumferential direction of the green compact (the area is a complete area, which is an insulating area), at least in a part thereof. The surface in the complete area is rougher than that in an area molded with another die member, and the area molded with the other die member is relatively flat since the soft magnetic particles in the area have been deformed as described above. When a core is formed from such a green compact, the insulating area can intersect an eddy current and thus eddy current loss can be reduced even though a conductive portion formed by damaging the insulating layer lies on the outer circumferential surface of the green compact in the circumferential direction of the green compact at a position other than the position of the insulating area. Thus, a low-loss core can be formed from the green compact. Therefore, a green compact from which a low-loss core can be obtained can be manufactured with the manufacturing method according to the present invention.

A form of the green compact according to the present invention is one manufactured with the manufacturing method according to the present invention. An exemplary form of the green compact according to the present invention that is manufactured with the manufacturing method according to the present invention is one that has an outer circumferential surface that includes an insulating area, in which a complete insulating layer lies, at a portion of the outer circumferential surface and an area in which soft magnetic particles exposed from the insulating layer have become electrically conductive at another portion of the outer circumferential surface. Since a low-loss core can be obtained with the manufacturing method according to the present invention, a conductive portion is allowed to be present in a portion of the outer surface of the green compact. Therefore, the manufacturing method according to the present invention does not need to involve a step for removing the conductive portion, and thus a green compact from which a low-loss core can be obtained can be manufactured with a high productivity.

A die having a through hole that is filled with a raw-material powder is taken as an example of a die member, among the multiple die members, which is moved with respect to a green compact (compact body) when the green compact is removed from a compacting space. The die member can be constituted by one or multiple fragments. Specifically, the die may be formed by multiple fragments. A stick-like core rod that is inserted and disposed in the through hole of the die is taken as an example of a die member that is stationary with respect to the green compact. A single or multiple core rods may be used. In the case of taking a form in which one die and one core rod are used as the multiple die members, a moving mechanism can be made simple, and thus can be easily operated. Here, "a die member is stationary with respect to a green compact (compact body)" means that the die member is not moved in such a manner as to damage the insulating layer by rubbing against the green compact, and therefore the die member is allowed to move within a range that does not cause the insulating layer to become damaged.

As one form of the green compact according to the present invention, a form is exemplified in which when peak heights Rpk of linear load curves in the reference area, in the same-plane surface area, and in the separate-plane surface area are taken as Rpk1, Rpk2, and Rpk3, the ratio of the peak height Rpk2 to the peak height Rpk1 satisfies $Rpk2/Rpk1 \leq 5$, or the ratio of the peak height Rpk3 to the peak height Rpk1 satisfies $Rpk3/Rpk1 \leq 5$.

Upon examination, the inventors have found that, after a green compact having a surface or an area in which the ratio relating to the peak height Rpk of the linear load curve satisfies the condition of falling within a specific range has been formed, the green compact includes the above-described insulating area without having to be subjected to a subsequent step of removing a conductive portion, and thus a low-loss core can be obtained from the green compact. Thus, the productivity of low-loss cores can be increased by employing the above-described form.

As one form of a manufacturing method according to the present invention, a form is exemplified that includes the following filling step, pressurizing step, and removing step. In the filling step, the compacting space is filled with the coated soft magnetic powder, the compacting space being defined by a die that has a through hole and with which a part of the outer circumferential surface of the green compact is molded, a core rod with which another part of the outer circumferential surface of the green compact is molded, and a first punch disposed so as to cover one of opening portions of the through hole, the core rod being inserted and disposed in a space of the through hole. In the pressurizing step, the coated soft magnetic powder in the compacting space is pressurized using the first punch and a second punch disposed so as to face the first punch. In the removing step, a green compact, which has been obtained after pressurizing the coated soft magnetic powder, is removed from the compacting space by moving the die with respect to the formed green compact without moving the core rod with respect to the formed green compact.

In the above-described form of the method, the core rod can be kept stationary with respect to a green compact (compact body) when the green compact is removed from the die. Consequently, on an outer circumferential surface of the removed green compact, a part of an insulating layer with which the core rod has been in contact remains in a complete state. Therefore, if a green compact formed with the above-described form is used for a core, an eddy current can be intersected by the complete area including the complete insulating layer, that is, an insulating area. Thus, a green compact from which a low-loss core can be obtained can be manufactured with the above-described form.

As a form that includes the die and the core rod, a form is exemplified in which, in the pressurizing step, the coated soft magnetic powder is pressurized by moving the second punch while the first punch is fixed, and the die and the core rod are moved together with the moving of the second punch.

A raw-material powder (a coated soft magnetic powder) can be pressurized and compressed by moving only a second punch toward a first punch while the first punch is used as a fixed punch. In this case, however, part of the raw-material powder that lies near the second punch moves a long distance and thus soft magnetic particles constituting the part of a raw-material powder may rub against each other while being moved and to thus damage the insulating layers. Moreover, the part of the raw-material powder lying near the second punch is more likely to be pressurized than part of the raw-material powder lying near the first punch, and consequently it is difficult to uniformly pressurize the entirety of the raw-material powder fed into the compacting space. In the above-described form of the method in which the die and the core rod are moved together with the moving of the second punch, the part of the raw-material powder lying near the second punch moves a shorter distance. Thus, damage sustained by the insulating layer due to the movement can be suppressed, and uniformly pressurizing the raw-material powder fed into the compacting space can become easier. Furthermore, since the first punch is set to be a fixed punch in the above-described form, a moving mechanism can be made simple and thus can be operated easily.

As one form of a manufacturing method according to the present invention, a form is exemplified in which a plurality of green compacts are formed at the same time by defining a plurality of compacting spaces, in which the plurality of green compacts are formable, by the plurality of die members.

With an ordinary method of manufacturing a green compact, one green compact is manufactured by using one die and one lower punch. With the manufacturing method according to the present invention, although only one green compact can be manufactured, multiple green compacts can be manufactured in one run as with the above-described form of the method, by adjusting a position at which a certain die member (die, for example) is disposed with respect to another die member (core rod, for example). For example, in a form in which the above-described die and core rod are used, multiple green compacts can be concurrently formed if the inner circumference of the through hole and the outer circumference of the core rod have such shapes that the core rod is inserted and disposed at a center portion in an inner space of the through hole of the die and that multiple empty spaces are defined by the inner circumferential surface of the through hole of the die and the outer circumferential surface of the core rod. The above-described form is excellent in terms of productivity of green compacts, since with this form of the method, multiple green compacts can be manufactured in one run. Particularly, in the case where multiple core fragments are assembled into a core, multiple green compacts obtained with the above-described form can be used as the core fragments. Thus, the above-described form is also excellent in terms of productivity of cores.

A reactor core that includes the green compact according to the present invention is introduced as a core for a reactor according to the present invention.

In the case where the green compact according to the present invention is used for a core for a reactor, the reactor including the core has a low eddy current loss, and thus loss is kept low. The green compact according to the present invention can be used as a part or the entirety of the core for a reactor. If at least a part of a core for a reactor around which a coil is placed is constituted by the green compact according to the present invention, eddy current loss can be effectively reduced.

As one form of the core for a reactor according to the present invention, a form is exemplified in which a core is combined with a coil to form a reactor, the core has a parallel-to-flux surface that is disposed so as to be in parallel to a flux direction when the coil is excited, and the parallel-to-flux surface includes the same-plane surface area or the separate-plane surface area in a part thereof. Alternatively, a form is exemplified in which a part of the parallel-to-flux surface is molded with at least one of the die members that is kept stationary with respect to the green compact when the green compact is removed.

The same-plane surface area and the separate-plane surface area, which are relatively rough, are complete areas, that is, insulating areas, as described above. In addition, on the outer circumferential surface of the green compact obtained by the manufacturing method according to the present invention, the area that is molded with the at least one die member that is kept stationary with respect to the green compact when the green compact is removed also becomes a complete area including a complete insulating layer, that is, an insulating area. Since the above-described form of the core includes the parallel-to-flux surface that includes the insulating area in a part thereof, if the core is used in a reactor and a coil is excited, an eddy current can be intersected by the insulating area, and thus eddy current loss can be reduced.

Advantageous Effects of Invention

In the core for a reactor according to the present invention, loss is kept low. A low-loss core can be obtained from the green compact according to the present invention. The green compact can be manufactured by the method of manufacturing a green compact according to the present invention.

DESCRIPTION OF EMBODIMENTS

An embodiment according to the present invention will be described below.

Figure 1:
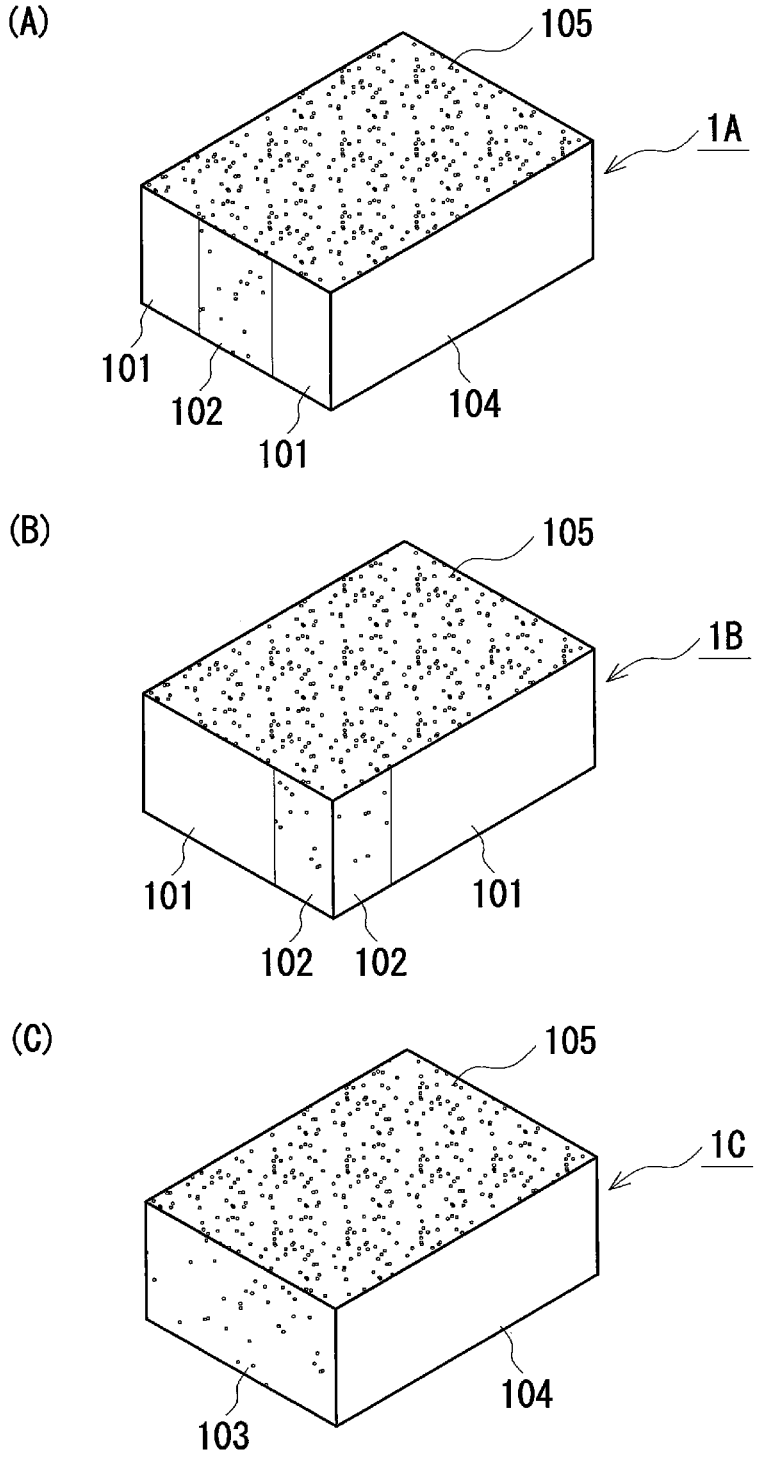
FIG. 1 includes perspective views schematically illustrating examples of green compacts according to the present invention, where part (A) illustrates an example in which a surface includes a rough area in a part thereof, part (B) illustrates an example in which multiple surfaces each include a rough area in a part thereof, and part (C) illustrates an example in which the entirety of a surface is a rough surface.

Referring to FIG. 1 first, a green compact according to the present invention will be described.

<Green Compact>

A green compact according to the present invention is a green compact obtained by compressing and compacting a coated soft magnetic powder constituted by coated particles, which are obtained by coating the surfaces of soft magnetic particles made of a soft magnetic material with insulating layers. The green compact is mainly composed of the soft magnetic particles and insulators interposed between the soft magnetic particles. The insulators are exemplarily constituted by the insulating layers. Other insulators formed by being subjected to a heat treatment after a compacting operation may be included. Materials, sizes, and other conditions of the soft magnetic material and the insulating layers will be described below.

An exemplary shape of the green compact according to the present invention is a rectangular parallelepiped as illustrated in FIG. 1. Various other pillar-like shapes, such as a polygonal prism in which $n=3$ or $n\geq5$, a column, and an elliptic cylinder may be employed. In the case of a polygonal prism in which $n\geq3$, a form in which at least one corner portion is rounded is included as the polygonal prism. The most distinctive characteristic of the green compact according to the present invention is that the green compact has parts that have different surface properties. Specifically, a part of a circumferentially extending outer circumferential surface constituted by at least one of surfaces of the green compact according to the present invention is a rougher area (has large projections and depressions), which lies so as to intersect the outer circumferential surface in the circumferential direction.

Figure 3:
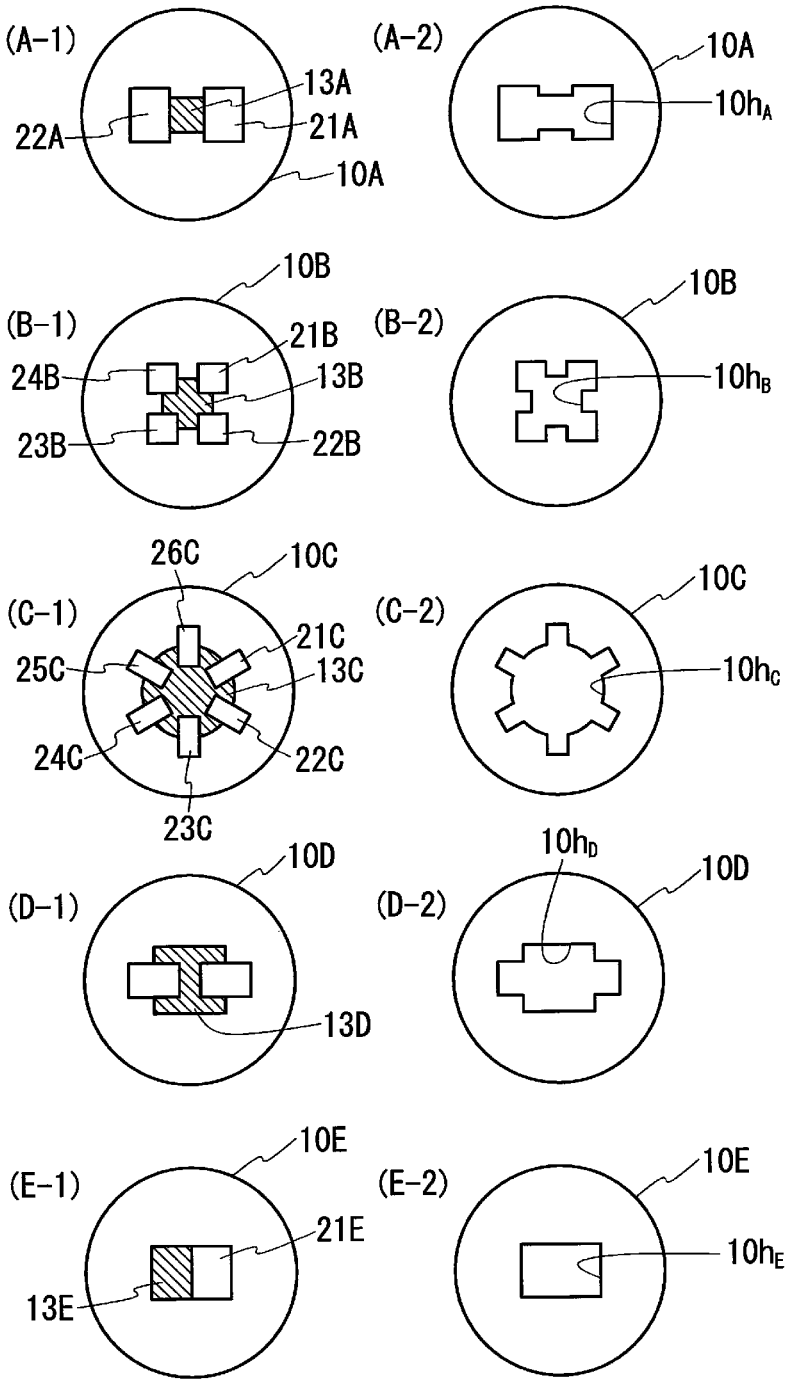
FIG. 3 includes plan views of dies and core rods for use in the method of manufacturing a green compact according to the present invention.

The meaning of the above-described "a part of the outer circumferential surface" includes the following forms [1] to [5] when outer circumferential surfaces consist of circumferentially continuous n surfaces (4 surfaces in the case of FIG. 1): [1] a form in which the part lies on a part of one surface (the form illustrated in part (A) of FIG. 1, for example); [2] a form in which the part lies on a part of one of two adjacent surfaces and on a part of the other one of the adjacent surfaces (the form illustrated in part (B) of FIG. 1, for example); [3] a form in which the part lies over the entirety of one or more but not more than $n-1$ surfaces (the form illustrated in part (C) of FIG. 1, for example); [4] a form in which the part lies over the entirety of one or more but not more than $n-1$ surfaces and lies on a part of another surface; and [5] a form in which the part lies over the entirety of one or more but not more than n−2 surfaces and lies on parts of two other surfaces (the form illustrated in part (C-1) or part (D-1) of FIG. 3, for example, which will be described below). In the case of a form in which an outer circumferential surface consists of one joint-less surface, such as a column or elliptic cylinder, the part represents a part of the outer circumferential surface.

A rectangular parallelepiped green compact 1A illustrated in part (A) of FIG. 1 has a relatively rough area 102 at a portion on one surface (on a left surface in part (A) of FIG. 1), and relatively flat areas 101 at other portions of the one surface. Here, all the flat areas 101 and the rough area 102 are rectangular and the rough area 102 is sandwiched by the two flat areas 101. When surface property values (here, any one selected from an arithmetic mean roughness Ra, a maximum height Rz, and a maximum valley depth Rv of a roughness curve) of the flat areas 101 and the rough area 102 are measured and the surface property values of the flat areas 101 (reference area) are taken as R1 while the surface property value of the rough area 102 is taken as R2, the ratio of the surface property value R2 to the surface property value R1 satisfies R2/R1≥2. Specifically, in the green compact 1A, the ratio of at least one of the surface property values, i.e., the ratio Ra2/Ra1 relating to the arithmetic mean roughness Ra, the ratio Rz2/Rz1 relating to a maximum height Rz, and the ratio Rv2/Rv1 relating to a maximum valley depth Rv of a roughness curve, satisfies the condition of being 2 or more. The rough area 102 in which the ratio R2/R1 of the surface property values satisfies R2/R1≥2 is a complete area over which a complete insulating layer lies, that is, an insulating area. The flat area 101 is an area in which soft magnetic particles are deformed or deformed soft magnetic particles are in contact with each other.

As described above, the green compact 1A has both the flat areas 101 and the rough area 102 on one of the outer surfaces. Therefore, when the green compact 1A is used for a core for a reactor or another device, the green compact 1A can intersect an eddy current with the presence of the rough area 102. Thus, the green compact 1A can contribute to forming of a low-loss magnetic part, such as a low-loss reactor.

An exemplary form of the green compact 1A is one in which, among five surfaces other than one surface (reference surface) that has both a flat area 101 and a rough area 102, one surface, which faces the reference surface, and two other surfaces that are circumferentially continuous to the one surface, i.e., three surfaces altogether, (three circumferentially continuous surfaces) are flatter in their entireties, and the remaining two surfaces that face each other are rougher in their entireties. When at least one of the above-described surface property values Ra, Rz, and Rv of each of the circumferentially continuous three surfaces is obtained, the obtained surface property value is substantially equal to the surface property value R1 of the flat area 101. That is, each of the three continuous surfaces is molded with the flat surface 104. With regard to the remaining two surfaces facing each other, when at least one of the above-described surface property values Ra, Rz, and Rv is obtained and the surface property value ratio R(2)/R1 relating to the obtained surface property value R(2) is taken, the surface property value ratio R(2)/R1 satisfies R(2)/R1≥2. In summary, the green compact 1A has one surface (reference surface) that includes a rough area 102 (same-plane surface area), in which the above-described surface property value ratio satisfies the condition of being 2 or more, and two rough surfaces 105, in which the above-described surface property value ratio satisfies the condition of being 2 or more. These two rough surfaces 105 facing each other are also the complete areas over which complete insulating layers entirely lie as in the rough area 102, that is, insulating areas. It should be noted, however, that an absolute value of the surface property value R(2) of the rough surfaces 105 does not necessarily coincide with an absolute value of the surface property value R2 of the rough area 102.

Figure 2:
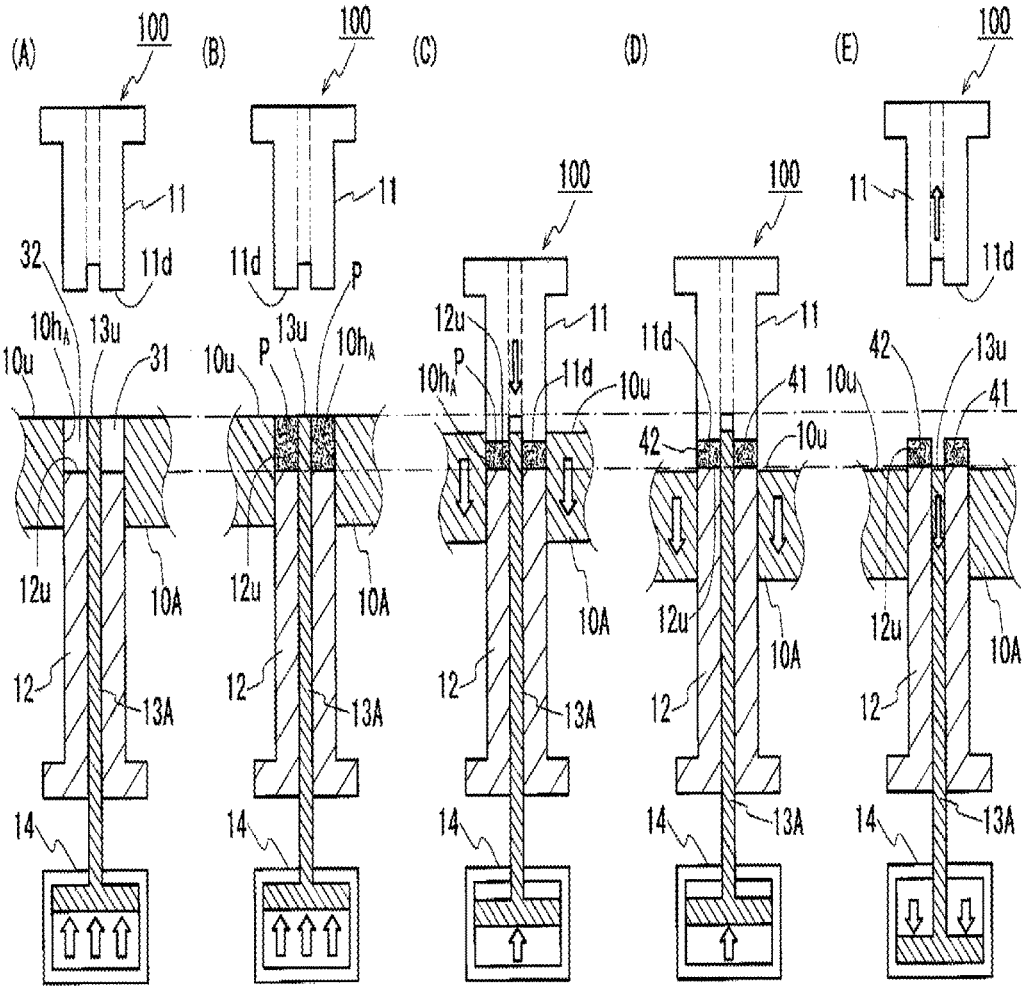
FIG. 2 illustrates steps of an exemplary procedure of a method of manufacturing a green compact according to the present invention.

The green compact 1A can be manufactured by using, for example, a compacting die set 100 that includes a die 10A and a core rod 13A illustrated in FIG. 2. A manufacturing method will be described below.

In the surface having the rough area 102, the size of the rough area 102 can be selected as appropriate. The rough area 102, however, has to lie so as to intersect the outer circumferential surfaces (here, constituted by the surface having the rough area 102 and the three flat surfaces 104) of the green compact 1A in the circumferential direction. Specifically, the rough area 102 lies across the two rough surfaces 105 facing each other. The circumferential size (hereinafter referred to as the width) of the rough area 102 depends on the size of the green compact, but, for example, the width may be approximately 5 mm or 2 mm. The above-described surface property value ratio or an absolute value of the surface property value can be changed depending on the size or compacting conditions of a coated soft magnetic powder constituting the green compact 1A. When the above-described surface property value ratio is 2 or more, a low-loss core can be obtained as illustrated in a test example, which will be described below.

Another exemplary form is a rectangular parallelepiped green compact 1B illustrated in part (B) of FIG. 1, for example. The green compact 1B has relatively rough areas 102 at portions of adjacent two surfaces (the left surface and the right surface in part (B) of FIG. 1), and relatively flat areas 101 (reference areas) at other portions of the two surfaces. Here, all the flat areas 101 and the rough areas 102 are rectangular, and the flat area 101 and the rough area 102 on each surface are adjacent to each other. Both the rough areas 102 are complete areas, in which the ratio R2/R1 relating to the surface property value Ra, Rz, or Rv satisfies R2/R1≥2, that is, insulating areas. In other words, the green compact 1B is different from the green compact 1A in that the green compact 1B has multiple surfaces (reference surfaces) each having a rough area 102 (same-plane surface area), in which the surface property value ratio R2/R1 satisfies R2/R1≥2. Configurations or effects other than this different point are the same as those in the green compact 1A, and thus the points that are in common with those in the green compact 1A will not be described. Outer surfaces of the green compact 1B include two surfaces (reference surfaces) each having a rough area 102, two flat surfaces in each of which a value that is substantially equal to the surface property value R1 is obtained, and two rough surfaces 105 in which the above-described surface property value ratio satisfies the condition of being 2 or more.

The green compact 1B can be manufactured by using, for example, a compacting die set (see FIG. 2) including a die 10B and a core rod 13B illustrated in part (B-1) of FIG. 3. A manufacturing method will be described below.

Another exemplary form is a rectangular parallelepiped green compact 1C illustrated in part (C) of FIG. 1, for example. In the green compact 1C, the entirety of one rectangular surface (left surface in part (C) of FIG. 1) is a relatively rough surface 103, while another surface facing the one rough surface 103, and two surfaces that are circumferentially continuous to the other surface, i.e., three surfaces altogether, (three circumferentially continuous surfaces) are entirely relatively flat surfaces 104. The remaining two opposing surfaces are rough surfaces 105. When at least one of the above-described surface property values Ra, Rz, and Rv of each of the rough surface 103 and the flat surfaces 104 is obtained, and when the surface property values of the flat surfaces 104 (reference surfaces) are taken as R1 and the surface property value (a surface property value of an area (separate-plane surface area) selected from the rough surface 103) of the rough surface 103 is taken as R3, the ratio of the surface property value R3 to the surface property value R1 satisfies R3/R1≥2. As described above, when the surface property value ratio R(2)/R1 in the rough surface 105 (an area (separate-plane surface area) selected from the rough surface 105) is obtained, the ratio R(2)/R1 satisfies R(2)/R1≥2. That is, the green compact 1C is different from the green compact 1A in that the green compact 1C has three rough surfaces (surfaces each having a separate-plane surface area in which the above-described surface property value ratio satisfies the condition of being 2 or more) that are adjacent to one flat surface 104 (reference surface). Configurations or effects other than this different point are the same as those in the green compact 1A, and thus the points that are in common with those in the green compact 1A will not be described.

The green compact 1C can be manufactured by using, for example, a compacting die set (see FIG. 2) including a die 10E and a core rod 13E illustrated in part (E-1) of FIG. 3. A manufacturing method will be described below.

<Method of Manufacturing Green Compact>

A method of manufacturing a green compact according to the present invention will be described now. First, a compacting die set used in the manufacturing method will be described.

[Compacting Die Set]

In the manufacturing method according to the present invention, typically, a compacting die set is used that includes a cylindrical die having a through hole, and a pair of pillar-like first and second punches, which are inserted from corresponding opening portions of the through hole of the die and are disposed so as to face each other in the through hole. Particularly, the manufacturing method according to the present invention involves the use of a compacting die set including at least one stick-like core rod that is inserted and disposed in an inner space of the through hole of the die. In the manufacturing method according to the present invention, a compacting space in the form of a closed-end cylinder is defined by one surface of one of the punches (a surface facing the other punch), a part of inner circumferential surfaces of the die, and a part of outer circumferential surfaces of the core rod. A raw-material powder fed into the compacting space is pressurized and compressed by using the two punches to produce a green compact (compact body). End surfaces of the green compact are molded with the opposing surfaces of the two punches, and the outer circumferential surfaces of the green compact are molded with the part of the inner circumferential surfaces of the die and the part of the outer circumferential surfaces of the core rod. In short, with the manufacturing method according to the present invention, the outer circumferential surfaces of one green compact are molded with multiple die members including the die and the core rod.

A compacting die set 100, which is a specific example illustrated in FIG. 2, includes a cylindrical die 10A having a through hole 10$h_A$, a pair of pillar-like upper and lower punches 11 and 12 that are inserted into and drawn from the through hole 10$h_A$, and a stick-like core rod 13A that is inserted and disposed in an inner space of the through hole 10$h_A$. FIG. 2 illustrates vertical sections of the die 10A, the lower punch 12, and the core rod 13A.

(Die and Core Rod)

The inner circumference of the through hole in the die and the outer circumference of the core rod may have various different shapes. A shape that can be formed by inserting and disposing the core rod in the through hole of the die should appropriately be selected such that a green compact having desired outer circumferential surfaces can be formed.

Like a die 10A illustrated in part (A-1) and part (A-2) of FIG. 3, a form is exemplified in which two rectangular spaces 21A and 22A are defined when a through hole 10$h_A$ has a shape of a profile of multiple continuous rectangles (polygonal shape (letter H shape, here)), a core rod 13A has a prismatic shape that has a rectangular (square, here) cross section, and the core rod 13A is inserted and disposed in the through hole 10$h_A$. In this form, two compacting spaces 31 and 32 (part (A) of FIG. 2) can be formed with the spaces 21A and 22A and the lower punch 12 (FIG. 2) and thus two rectangular parallelepiped green compacts can be formed in one run. A part of the four surfaces constituting the outer circumferential surfaces of each of the obtained green compacts 41 and 42 (part (E) of FIG. 2) is molded with an outer circumferential surface of the core rod 13A, and the other part of the four surfaces is molded with inner circumferential surfaces of the through hole 10$h_A$ of the die 10A.

Here, although a form is illustrated in which a part of one of four surfaces constituting the outer circumferential surfaces of each of the green compacts 41 and 42 is molded with an outer circumferential surface of the core rod 13A (see the green compact 1A illustrated in part (A) of FIG. 1), the size of an area molded with the core rod 13A can be appropriately selected. In the case where the core rod is prismatic as in this example, the width of one surface of the core rod can be appropriately changed. For example, the through hole of the die and the core rod may be configured such that the entirety of one of the outer circumferential surfaces of each green compact can be molded with the core rod. In this case, the green compact 1C illustrated in part (C) of FIG. 1 is obtained. Alternatively, the through hole of the die and the core rod may be configured such that, among two adjacent surfaces constituting the outer circumferential surfaces of each green compact, a part or the entirety of one surface and a part or the entirety of another surface can be molded with the core rod. In this case, the core rod should be a component having an L-shaped cross section. Additionally, in this case, the green compact 1B illustrated in part (B) of FIG. 1 is obtained.

Instead, like the die 10D and the core rod 13D illustrated in part (D-1) and part (D-2) of FIG. 3, the entirety of one of the outer circumferential surfaces of each green compact and a part of each of two surfaces that are adjacent to the one surface may be molded with the core rod 13D. The die 10D has a polygonal (a cross-shaped, here) through hole 10$h_D$, and the core rod 13D is a prism having an H-shaped end face or cross section. The through hole of the die and the core rod may be configured such that the entirety of the one surface and the entireties of two surfaces adjacent to the one surface are molded with the core rod.

The size of the area molded with the core rod is sufficiently large if the area can intersect an eddy current when an obtained green compact is used for a core. Depending on the size of the green compact, the area molded with the core rod may be a thin strip-like area having the width as thin as approximately 5 mm or even 2 mm. As the area to be molded with the core rod increases, the green compact has a larger insulating area in which a complete insulating layer is maintained. When this green compact is used for a core, an eddy current can be more securely intersected. Moreover, since the core rod becomes wider, the strength of the core rod itself easily increases. The shape, width, or other conditions of the core rod should be selected such that an area to be molded with the core rod has a desired size.

Alternatively, like a die 10B illustrated in part (B-1) and part (B-2) of FIG. 3, a form is exemplified in which four rectangular spaces 21B to 24B are defined when a through hole 10$h_B$ has a shape of a profile of multiple continuous rectangles (polygonal shape), a core rod 13B has a prismatic shape that has a cross-shaped cross section, and the core rod 13B is inserted and disposed in the through hole 10$h_B$. In this form, four compacting spaces can be formed with the spaces 21B to 24B and the lower punch, and thus four rectangular parallelepiped green compacts can be formed in one run. Among four surfaces constituting the outer circumferential surfaces of each green compact thus formed, a part across the two adjacent surfaces (an L-shaped area), which forms one corner portion, is molded with outer circumferential surfaces of the core rod 13B, and the other part of the four surfaces is molded with inner circumferential surfaces of the through hole 10$h_B$ (see the green compact 1B illustrated in part (B) of FIG. 1). Also in this form, the through hole of the die and the core rod may be configured, for example, such that the entireties of the adjacent two surfaces or the entirety of one of the two adjacent surfaces and a part of the other one of the surfaces are molded with the core rod.

Alternatively, as in the case of a die 10C illustrated in part (C-1) and part (C-2) of FIG. 3, a form is exemplified in which six rectangular spaces 21C to 26C are defined when a through hole 10$h_C$ has a shape of a profile of an odd form constituted by a combination of straight lines and curves (a gear shape, here), a core rod 13C has a gear-like prismatic shape, and the core rod 13C is inserted and disposed in the through hole 10$h_C$. In this form, six compacting spaces can be formed with the spaces 21C to 26C and the lower punch, and thus six rectangular parallelepiped green compacts can be formed in one run. Among four surfaces constituting the outer circumferential surfaces of each green compact thus formed, an angular-C shaped area constituted by one surface and a part of each of two surfaces adjacent to the one surface is molded with outer circumferential surfaces of the core rod 13C, and the other part of the four surfaces is molded with inner circumferential surfaces of the through hole 10$h_C$. Also in this form, the through hole of the die and the core rod may be configured, for example, such that the entireties of the above three surfaces or the entirety of the one surface, the entirety of one of the two adjacent surface, and a part of the other one of the two surfaces are molded with the core rod.

Alternatively, as in the case of a die 10E illustrated in part (E-1) and part (E-2) of FIG. 3, a form is exemplified in which one rectangular space 21E is defined when a through hole 10$h_E$ and a core rod 13E both have a rectangular cross section, and the core rod 13E is inserted and disposed in the through hole 10$h_E$. Here, among four surfaces constituting the outer circumferential surfaces of the obtained green compact, the entirety of one of the four surfaces is molded with an outer circumferential surface of the core rod 13E, and the other part (remaining three of the four surfaces) is molded with the inner circumferential surfaces of the through hole 10$h_E$ (see the green compact 1C illustrated in part (C) of FIG. 1). Also in this form, the core rod may be appropriately changed, for example, to be rectangular parallelepiped, L-shaped, angular-C-shaped, or in other shapes such that only a part of the above-described one surface, a part or the entirety of the one surface and a part or the entirety of another surface adjacent to the one surface, or the entirety of the one surface and a part or the entirety of each of two surfaces adjacent to the one surface are molded with the core rod. The shape of the inner circumference of the die should appropriately be changed.

As described above, by combining a die and a core rod, one or multiple green compacts can be manufactured by forming one or multiple spaces in one die. By increasing the number of spaces to be defined in one die, a larger number of green compacts can be formed in one run and thus the productivity of green compacts can be improved. Here, when a raw-material powder with which the compacting spaces are filled is pressurized and compressed, a force with which the green compacts press the core rod occurs. In a case where the number of spaces formed in one die is two as in the case of part (A-1) of FIG. 3, the center of the die is aligned with the center of the core rod, and the spaces are disposed so as to be axisymmetric with each other with respect to the center line of the die. Accordingly, a force with which one green compact presses the core rod conterbalances a force with which the other green compact presses the core rod. Therefore, the core rod is prevented from substantially pressing the die, so that friction between the die and the core rod can be reduced and seizing of the die or the core rod due to excessive rubbing of each other can be prevented.

In FIG. 3, the through holes 10$h_A$ to 10$h_E$ have angular shapes, but may have shapes having corner portions appropriately rounded. By rounding the corner portions, it becomes easy to remove the green compact and thus the compacting efficiency can be improved. Also, FIG. 3 illustrates the forms in which profiles of both the through hole and the core rod are constituted by straight lines, but a form in which profiles are constituted by curves and a form in which profiles are constituted by a combination of curves and straight lines are also adoptable. For example, the shapes of the through hole and the core rod can be changed such that a green compact having a non prismatic shape, such as a cylindrical or elliptic cylindrical shape, can be formed.

(Upper Punch and Lower Punch)

The upper punch 11 and the lower punch 12 are cylinders each having a through hole that allows the core rod 13A to be inserted therethrough, and the core rod 13A is inserted into the through hole of the lower punch 12 so as to be movable with respect to the lower punch 12. When the core rod 13A is inserted into the through hole of the upper punch 11, the through hole serves as a guide for moving the upper punch 11 and as a holder of the core rod 13A at the time of pressurizing and compressing operations. A surface of the upper punch 11 facing the lower punch 12 (pressing surface 11*d*) and a surface of the lower punch 12 facing the upper punch 11 (pressing surface 12*u*) both have such shapes as to fit to the spaces 21A and 22A defined by the die 10A and the core rod 13A (forms that have two rectangular surfaces, here). Note that although the upper punch 11 and the lower punch 12 are described as each being an integrated body here, at least one of the upper punch and the lower punch may be constituted by multiple components, which are movable independently of one another.

The compacting die set 100 is made of, for example, an appropriate high strength material (such as a high-speed steel) that has heretofore been used for forming a green compact (mainly made of metal powder).

(Moving Mechanism)

At least one of the paired punches and the die are movable with respect to each other. In the compacting die set 100 illustrated in FIG. 2, the lower punch 12 is unable to move by being fixed to a body apparatus, which is not illustrated, while the die 10A and the upper punch 11 can be vertically moved by a moving mechanism, which is not illustrated. Other adoptable configurations include one in which both punches 11 and 12 are movable while the die 10A is fixed, and one in which the die 10 and the punches 11 and 12 are all movable. By fixing one of the punches (lower punch 12, here), the moving mechanism is prevented from being complex, and thus a moving operation can be easily controlled.

If the lower punch and the core rod are configured so as to be movable with respect to each other, when multiple green compacts are manufactured in one run in a manner to be described below, the multiple green compacts can be collected in one run. Here, the core rod 13A is configured to be vertically movable by a hydraulic or pneumatic moving mechanism 14.

The lower punch and the core rod can be configured so as to be immobile with respect to each other, for example, the lower punch and the core rod can be formed as a single unit. In this form, if multiple green compacts are manufactured in one run, the green compacts should be collected one by one.

Alternatively, a form is adoptable in which a die member, with which an outer circumferential surface of a green compact is molded, is disposed on the upper punch. For example, a protruding upper punch, in which a protrusion corresponding to the core rod 13A is integrally formed in an upper punch, may be adopted, or a form in which an upper punch includes a movable rod corresponding to the core rod 13A may be adoptable. In such a form, at the time of feeding powder, the core rod 13A is disposed such that a desired space is defined and the protrusion or the movable rod is brought into contact with the core rod 13A together with movement of the upper punch, and at the time of the pressurizing or compressing operation, the core rod 13A is pressed down by the protrusion or the movable rod, so that a part of the outer circumferential surfaces of the green compact is molded with the protrusion or the movable rod in place of the core rod 13A. As will be described below, after the pressurizing and compressing operations, the die 10A should be moved to release the green compacts and then the upper punch and the protrusion or the movable rod should be separated from the green compacts.

(Additional Information)

In the manufacturing method according to the present invention, a lubricant may be applied to the compacting die set (the inner circumferential surfaces of the die or the outer circumferential surfaces of the core rod, in particular). Adoptable examples of lubricants include solid lubricants and liquid lubricants, examples of the solid lubricants including metallic soap such as lithium stearate, fatty acid amide such as octadecanamide, and higher fatty acid amide such as ethylenebisstearamide, and examples of the liquid lubricants including liquid dispersion obtained by dispersing a solid lubricant into a liquid medium such as water.

Now, a raw-material powder used in the method of manufacturing a green compact according to the present invention will be described.

[Coated Soft Magnetic Powder]

In the manufacturing method according to the present invention, a coated soft magnetic powder is adopted as a raw-material powder, the coated soft magnetic power being constituted by soft magnetic particles made of a soft magnetic material and insulating layers disposed on the surfaces of the soft magnetic particles. The composition of the soft magnetic particles constituting the green compact manufactured by the manufacturing method according to the present invention substantially maintains the composition of the raw-material powder.

(Soft Magnetic Particle)

A metal, particularly one containing 50 wt % or more of iron is preferable as a soft magnetic material. For example, pure iron (Fe) or a ferroalloy selected from an iron (Fe)-silicon (Si)-based alloy, an iron (Fe)-aluminum (Al)-based alloy, an iron (Fe)-nitrogen (N)-based alloy, an iron (Fe)-nickel (Ni)-based alloy, an iron (Fe)-carbon (C)-based alloy, an iron (Fe)-boron (B)-based alloy, an iron (Fe)-cobalt (Co)-based alloy, an iron (Fe)-phosphorus (P)-based alloy, an iron (Fe)-nickel (Ni)-cobalt (Co)-based alloy, and an iron (Fe)-aluminum (Al)-silicon (Si)-based alloy is adoptable. Particularly, a core having a high magnetic permeability and a high flux density is obtained from a green compact made of pure iron containing 99 wt % or more of iron, and a green compact made of a ferroalloy easily reduces eddy current loss and thus a core in which loss is kept lower can be formed from the green compact.

The average particle diameter of the soft magnetic particles is preferably 1 μm or more but not more than 70 μm. Soft magnetic particles having the average particle diameter of 1 μm or more have an excellent fluidity. The size of the soft magnetic particles constituting the green compact obtained after a compacting operation depends on the size of the raw-material powder. Therefore, when a green compact manufactured by the manufacturing method according to the present invention by using a raw-material powder in which the average particle diameter is 1 μm or more is used for a core, the green compact can suppress an increase in hysteresis loss. When a green compact manufactured by using a raw-material powder in which the average particle diameter is not more than 70 μm is used for a core that is to be used at high frequencies of 1 kHz or higher, eddy current loss can be effectively reduced. Particularly, when the average particle diameter is 50 μm or more, an effect of reduction in hysteresis loss can be easily obtained and the powder can be easily handled. The average particle diameter of the raw-material powder is a particle diameter obtained by arranging the diameters of particles in order from particles having a smaller diameter in a particle diameter histogram until the sum of mass of the measured particles reaches 50% of the gross mass and determining the particle diameter at that point, i.e., the average particle diameter is a 50% mass particle diameter.

(Insulating Layer)

An appropriate insulating material that is excellent in terms of insulating properties can be used for the insulating layer. For example, an oxide, a nitride, or a carbide of one or more metallic elements selected from iron (Fe), aluminum (Al), calcium (Ca), manganese (Mn), zinc (Zn), magnesium (Mg), vanadium (V), chromium (Cr), yttrium (Y), barium (Ba), strontium (Sr), and rare earth elements (except Y), such as metallic oxide, metallic nitride, or metallic carbide that contains any of the above metallic elements can be adopted as the insulating material. Alternatively, a compound other than metallic oxide, metallic nitride, and metallic carbide may be adopted as the insulating material, such as one or more compounds selected from a phosphorus compound, a silicon compound, a zirconium compound, and an aluminum compound. Other examples of the insulating material include a metallic salt compound, such as a phosphate metallic salt compound (typically, iron phosphate, manganese phosphate, zinc phosphate, calcium phosphate, or the like), a borate metallic salt compound, a silicate metallic salt compound, or a titanate metallic salt compound.

Since the phosphate metallic salt compound has an excellent deformability, if the insulating layer made of the phosphate metallic salt compound is employed, the insulating layer easily deforms so as to follow deformation of the soft magnetic metal particles at the time of forming a green compact, and thus the insulating layer is negligibly damaged and a green compact in which the insulating layer remains in a complete state is more likely to be obtained. Moreover, the insulating layer made of a phosphate metallic salt compound has a property with which the insulating layer closely adheres to soft magnetic particles made of a ferrous material, and thus is less likely to be detached from the surface of the particles.

Other examples of the insulating material include resins, such as a thermoplastic resin or a non-thermoplastic resin, or a higher fatty acid salt. Particularly, a silicone-based organic compound such as a silicone resin is highly resistant to heat, and thus the obtained green compact (compact body) is less likely to decompose when subjected to a heat treatment.

A chemical conversion treatment such as a phosphate conversion treatment can be adopted for forming the insulating layer. Alternatively, a sol-gel operation in which a solution is sprayed and a precursor is used may be adopted for forming the insulating layer. When the insulating layer is made of the silicone-based organic compound, an operation such as a wet coating operation using an organic solution or a direct coating operation using a mixer may be adopted.

The thickness of the insulating layer contained in each soft magnetic particle ranges from 10 nm to 1 μm, for example. When the thickness is 10 nm or more, insulation between the soft magnetic particles can be secured, while when the thickness is not more than 1 μm, the presence of the insulating layer suppresses reduction of the magnetic component proportion of the green compact. In short, when a core is made from the green compact, a considerable reduction in a flux density can be prevented from occurring. The thickness of the insulating layer is an average value obtained by deriving a value corresponding to the thickness of the insulating layer in consideration of a film composition obtained by composition analysis (using transmission electron microscope energy dispersive X-ray spectroscopy (TEM-EDX)) and an element content obtained by inductively coupled plasma-mass spectrometry (ICP-MS), and then, by confirming and determining the order of the corresponding value of the thickness that has been derived in advance as being an appropriate value by directly observing the insulating layer through a TEM image.

A lubricant may be added to the raw-material powder. Examples of the lubricant include a solid lubricant and inorganic substances such as boron nitride or graphite.

Referring now to FIG. 2, the manufacturing method according to the present invention will be described more specifically. Here, description will be given by taking a case of using the compacting die set 100 including the die 10A and the prismatic core rod 13A illustrated in part (A-1) and part (A-2) of FIG. 3 as an example.

[Compacting Procedure]

(Filling Step)

As illustrated in part (A) of FIG. 2, the upper punch 11 is brought to a predetermined stand-by position above the die 10A. In addition, the die 10A and the core rod 13A are moved upward to predetermined positions. Here, the core rod 13A is moved by the moving mechanism 14 such that an end face (top surface 13*u*) of the core rod 13A is flush with a top surface 10*u* of the die 10A and such that the core rod 13A is inserted into an inner space of the through hole $\mathbf{10}h_A$ of the die 10A. Consequently, one opening portion of the through hole $\mathbf{10}h_A$ of the die 10A is blocked by a pressing surface 12*u* of the lower punch 12 and thus two closed-end cylindrical compacting spaces 31 and 32 can be defined by the pressing surface 12*u* of the lower punch 12, the through hole $\mathbf{10}h_A$ of the die 10A, and the core rod 13A.

A coated soft magnetic powder is prepared as a raw-material powder. As illustrated in part (B) of FIG. 2, the prepared raw-material powder P is fed into the two compacting spaces 31 and 32 by a powder feeding apparatus, which is not illustrated.

(Pressurizing Step)

As illustrated in part (C) of FIG. 2, the upper punch 11 is moved downward and inserted into the through hole $\mathbf{10}h_A$ of the die 10A, so that the raw-material powder P is pressurized and compressed by the two punches 11 and 12. As the upper punch 11 moves, an upper portion of the core rod 13A is automatically inserted into and held by a through hole of the upper punch 11.

A compacting pressure ranges from 390 MPa to 1,500 MPa, for example. When the compacting pressure is 390 MPa or higher, the raw-material powder P can be fully compressed and a relative density of the green compact can be increased. When the compacting pressure is 1,500 MPa or lower, it is possible to suppress damaging of the insulating layer due to a contact between coated soft magnetic particles constituting the raw-material powder P. It is more preferable that the compacting pressure ranges from 500 MPa to 1,300 MPa.

Only the upper punch 11 may be moved toward the fixed lower punch 12 to pressurize and compress the raw-material powder P, but here, the die 10A and the core rod 13A are moved together with the upper punch 11. Specifically, after the upper punch 11 has come into contact with the raw-material powder P, the die 10A and the core rod 13A are moved downward like the upper punch 11. Here, the core rod 13A is moved downward by reducing the pressure of the moving mechanism 14.

In the form in which the die 10A and the core rod 13A are moved together with the upper punch 11, the raw-material powder P in the compacting spaces 31 and 32 that comes into contact with the upper punch 11 and that stays near the upper punch 11 moves a shorter distance toward the lower punch 12, and thus the insulating layer can be prevented from being damaged due to an overloading movement. Furthermore, in this form, the two punches 11 and 12 can uniformly apply pressures to the raw-material powder Pin the compacting spaces 31 and 32. The rate of moving the die 10A, the core rod 13A, and the upper punch 11 can be selected as appropriate.

(Removing Step)

After performing the predetermined pressurizing step, the die 10A is moved with respect to two green compacts 41 and 42 without the core rod 13A being moved with respect to the green compacts 41 and 42, as illustrated in part (D) of FIG. 2. Here, the core rod 13A and the green compacts 41 and 42 are not moved, but only the die 10A is moved downward. At this time, a part of the outer circumferential surfaces of each green compact 41 or 42 that has been in contact with the die 10A rubs against the through hole $\mathbf{10}h_A$ of the die 10A due to a reaction force against a pressing force of the die 10A. The two green compacts 41 and 42, which have been exposed from the through hole $\mathbf{10}h_A$ of the die 10A, are released from the die 10A and are in contact with the core rod 13A without applying a load to the core rod 13A.

The die 10A is moved down to such a position that the top surface 10*u* of the die 10A is flush with the pressing surface 12*u* of the lower punch 12 or such a position that the pressing surface 12*u* of the lower punch 12 comes above the top surface 10*u* of the die 10A. When the two green compacts 41 and 42 are completely exposed from the die 10A, the upper punch 11 is moved upward as illustrated in part (E) of FIG. 2. Here, the die 10A is moved while the green compacts 41 and 42 are nipped by the pressing surface 11*d* of the upper punch 11 and the pressing surface 12*u* of the lower punch 12, and the upper punch 11 is moved in the subsequent step. However, the upper punch 11 may be moved upward at the same time when the die 10A is moved, or the upper punch 11 may be moved earlier than the die 10A.

After the upper punch 11 is moved, the green compacts 41 and 42 are allowed to be collected. Thus, the green compacts 41 and 42 can be collected separately using a manipulator, for example. Here, the green compacts 41 and 42 are made concurrently collectable by moving the core rod 13A down to a position at which the top surface 13*u* of the core rod 13A is flush with the top surface 10*u* of the die 10A. While the core rod 13A is moved downward, the green compacts 41 and 42 and the core rod 13A do not substantially rub against each other since the core rod 13A and the green compacts 41 and 42 are in contact with each other with no load being applied to each other, as described above. Therefore, the insulating layers of the green compacts 41 and 42 in an area molded with the core rod 13A are substantially prevented from being damaged by the movement of the core rod 13A.

In the case where the compacting operation is sequentially performed, after the green compacts 41 and 42 are collected and removed from the compacting die set 1, a series of steps for forming subsequent green compacts should be repeatedly performed in the above-described order from the step of forming a compacting space, to the step of filling the compacting space with a raw-material powder, then to the pressurizing step, and finally to the removing step.

In the obtained green compacts 41 and 42, a surface property value ratio $R_{13A}/R_{10A}$ satisfies $R_{13A}/R_{10A} \geq 2$ when, for example, a measurement region is appropriately selected from each of the area molded with the through hole $\mathbf{10}h_A$ of the die 10A and the area molded with the core rod 13A, at least one of the above-described surface property values Ra, Rz, and Rv are measured at each position, and the surface property values are defined as $R_{10A}$ and $R_{13A}$. In the green compacts 41 and 42, a surface property value ratio $R_{11\ or\ 12}/R_{10A}$ satisfies $R_{11\ or\ 12}/R_{10A} \geq 2$ when a measurement region is appropriately selected from either the area molded with the pressing surface 11*d* of the upper punch 11 or the area molded with the pressing surface 12*u* of the lower punch 12, a surface property value of the same type as the surface property value $R_{10A}$ is measured at the position, and the surface property value is defined as $R_{11\ or\ 12}$. Further, in the green compacts 41 and 42, a peak height ratio $Rpk_{13A}/Rpk_{10A}$ satisfies $Rpk_{13A}/Rpk_{10A} \leq 5$ when a measurement region is appropriately selected from each of the area molded with the through hole $\mathbf{10}h_A$ of the die 10A and the area molded with the core rod 13A, peak heights of linear load curves at the positions are determined, and the peak heights are defined as $Rpk_{10A}$ and $Rpk_{13A}$.

[Effects]

With the manufacturing method according to the present invention, when a green compact (compact body) is removed from the compacting space, a part of the outer circumferential surfaces of the green compact does not substantially rub against a die member (a core rod, in the embodiment) that defines the compacting space. Therefore, the powder that comes into contact with the die member is less likely to be plastically deformed, and thus the insulating layer is less likely to be damaged or is not at all damaged by the plastic deformation. Thus, a green compact having a complete insulating area at a part of the outer circumferential surfaces (the above-described green compact 1A, 1B, or 1C, for example) can be manufactured with the manufacturing method according to the present invention. If a core is made from this green compact, the obtained core can intersect an eddy current and reduce eddy current loss with the presence of the insulating area. Accordingly, with the manufacturing method according to the present invention, it is possible to provide a green compact from which a low-loss core can be obtained.

In the case of forming a core from a green compact obtained by the manufacturing method according to the present invention (the green compact according to the present invention), if the green compact (compact body) is subjected to a heat treatment to remove distortion caused at the compacting operation, hysteresis loss in the core can be reduced and thus loss in the core can be further reduced. As the temperature set at the time of the heat treatment is higher, hysteresis loss can be reduced further. However, components of the insulating layer may be thermally decomposed if the temperature is excessively high. Thus, the temperature should be selected from such a range as to fall below heat decomposition temperatures of the components. Typically, the heating temperature ranges from approximately 300° C. to approximately 700° C. and the retention time ranges from 30 minutes to 60 minutes. In the case where the insulating layer is made of amorphous phosphate such as iron phosphate or zinc phosphate, the heating temperature is preferably up to of the order of 500° C. In the case where the insulating layer is made of a highly heat-resistant insulating material, such as a metallic oxide or a silicone resin, the heating temperature can be increased up to 550° C. or higher, 600° C. or higher, or even 650° C. or higher. The heating temperature and the retention time can be appropriately selected depending on the components of the insulating layer. The above-described surface properties do not greatly change before and after the heat treatment, and thus, the surface properties obtained after the heat treatment is substantially the same as the surface properties obtained before the heat treatment.

<Application of Green Compact>

The green compact according to the present invention can be preferably employed as a core, such as a reactor core around which a coil is placed. The green compact according to the present invention can be preferably employed as a magnetic core included in a reactor, in which the magnetic core includes a coil including a pair of coil elements, a pair of pillar-like inner core units (middle core units) around which the coil elements are placed, and an outer core unit (side core unit) around which the coil elements are not placed, the coil elements are arranged side by side such that axes of the coil elements are in parallel to each other, and the outer core unit constitutes a closed magnetic circuit by being connected to the inner core units. Particularly, in the case where the inner core units are each formed by combining multiple core fragments, the green compact according to the present invention can be employed as at least one of the core fragments, or preferably, all the core fragments. Here, it is preferable to dispose the core fragment such that a surface including the above-described rough area 102 or a rough surface 103, typically, a surface including an area molded with the core rod or a surface molded with the core rod becomes parallel to a direction of a magnetic flux when the coil of the reactor is excited. That is, the fragment is disposed such that the above-described rough area 102 or rough surface 103, which serves as an insulating area, faces an inner circumferential surface of the coil. With this disposition, when the coil is excited, the reactor including the inner core unit can intersect an eddy current that would possibly occur in the inner core unit, and thus can reduce eddy current loss with the presence of the insulating area. Also in the case of forming the outer core unit by combining multiple core fragments, the green compact according to the present invention can be employed as at least one of the core fragments.

<Test Example>

Green compacts were formed and dust cores were formed by using the formed green compacts. Loss in magnetic parts including the dust cores was examined.

[Sample No. 1]

As Sample No. 1, multiple green compacts (in a rectangular parallelepiped shape of 30 mm×40 mm×thickness 15 mm) were formed by using the compacting die set 100 (including the die 10A) illustrated in FIG. 2 with the manufacturing method according to the present invention. A compacting pressure was set to 700 MPa. The width of an area molded with the core rod was set to 20 mm.

In this test, prepared as a coated soft magnetic powder was one in which an insulating layer (having a thickness of not larger than approximately 20 nm) made of phosphate metallic salt compound was formed by a chemical conversion treatment on a pure iron powder (having an average particle diameter of 50 μm) manufactured by water-atomizing method.

[Sample No. 100]

As Sample No. 100, multiple green compacts (in a rectangular parallelepiped shape of 30 mm×40 mm×thickness 15 mm) having the same size as Sample No. 1 were formed from the same coated soft magnetic powder as Sample No. 1 by using a die having one rectangular through hole of 30 mm×40 mm and upper and lower punches each having an rectangular end face (pressing surface) of 30 mm×40 mm. The compacting pressure was set similarly to that for Test Example No. 1. The entirety of the outer circumferential surfaces (two surfaces of 30 mm×15 mm and two surfaces of 40 mm×15 mm, i.e., four surfaces altogether) of each green compact of Sample No. 100 was molded with the inner circumferential surfaces of the through hole of the die.

The green compacts (compact bodys) of each sample type were subjected to a heat treatment (at 400° C. for 30 minutes in an atmosphere of nitrogen) and thus thermally treated components were obtained. The multiple thermally treated components of each sample type thus obtained were circularly assembled into a test core, and a coil made of a wire was placed around each test core (coils having the same specifications were used for both sample types) to form a measurement object (corresponding to a magnetic part). In Sample No. 1, the measurement object was formed such that a surface having an area molded with the core rod 13A became parallel to a direction of a magnetic flux. In each measurement object, eddy current loss We (W) was measured using an alternating current (AC) B-H curve tracer at an excitation flux density Bm of 1 kG (=0.1 T) and at a measured frequency of 5 kHz. The results of the measurements are shown in Table I.

TABLE I

| Sample No. | Component with which outer circumferential surfaces of green compact are molded | Eddy current loss We (W) |
|---|---|---|
| 1 | Die and core rod | 1.9 |
| 100 | Die only | 21.1 |

As shown in Table I, it is found that a core in which eddy current loss is kept low can be obtained by using Sample No. 1, which is the green compact according to the present invention obtained by the manufacturing method according to the present invention in which the outer circumferential surfaces of the green compact are molded with multiple die members, and at the time of removing the green compact from the compacting space, one die member (core rod, here) is not moved with respect to the green compact while the other die member (die, here) is moved with respect to the green compact. In short, it is found that a green compact from which a low-loss core can be obtained can be manufactured with the manufacturing method according to the present invention.

In the green compact of each sample type, the surfaces molded with the die 10A and the core rod 13A in Sample No. 1 and the surface molded with the die in Sample No. 100 were observed using an optical microscope (at magnification of 1,000). As a result, the surface molded with the die of each sample type was observed as being a uniform metallic surface with the soft magnetic particles being expanded due to plastic deformation and thus contacting each other. In contrast, the surface molded with the core rod 13A in Sample No. 1, a boundary of a coated soft magnetic particle, which was thought to have constituted the raw-material powder, could be fully recognized. In other words, it was confirmed that the insulating layer remained in a complete state. In the end faces of the green compact of each sample type molded with the upper punch and the lower punch, boundaries of particles could be fully recognized like the one in the surface molded with the core rod 13A, since the end faces do not substantially rub against the corresponding punches.

The surface properties on the outer surfaces of each green compact of Sample No. 1 were measured at the area molded with the die, at the area molded with the core rod, and at the area molded with either the upper punch or the lower punch. Here, an arithmetic mean roughness Ra, a maximum height Rz, a maximum valley depth Rv of a roughness curve, and a peak height Rpk of a linear load curve were measured. The measurements were conducted by using a commercially-available measuring device for roughness in conformance with Japanese Industrial Standards (JIS) B 0601(2001)/International Organization for Standardization (ISO) 4287 (1997), JIS B 0651(2001)/ISO 3274(1996), JIS B 0633 (2001)/ISO 4288(1996), and JIS B 0671-2(2002)/ISO 3565-2(1996). Measurement can be performed using a measurement region, which is appropriately selected from the above-described areas and which have a predetermined measurement length. Here, measurement regions selected from the area molded with the die and from the area molded with the core rod corresponded to each other in terms of the circumferential direction. The measurement length was set to 4.0 mm.

Figure 4:
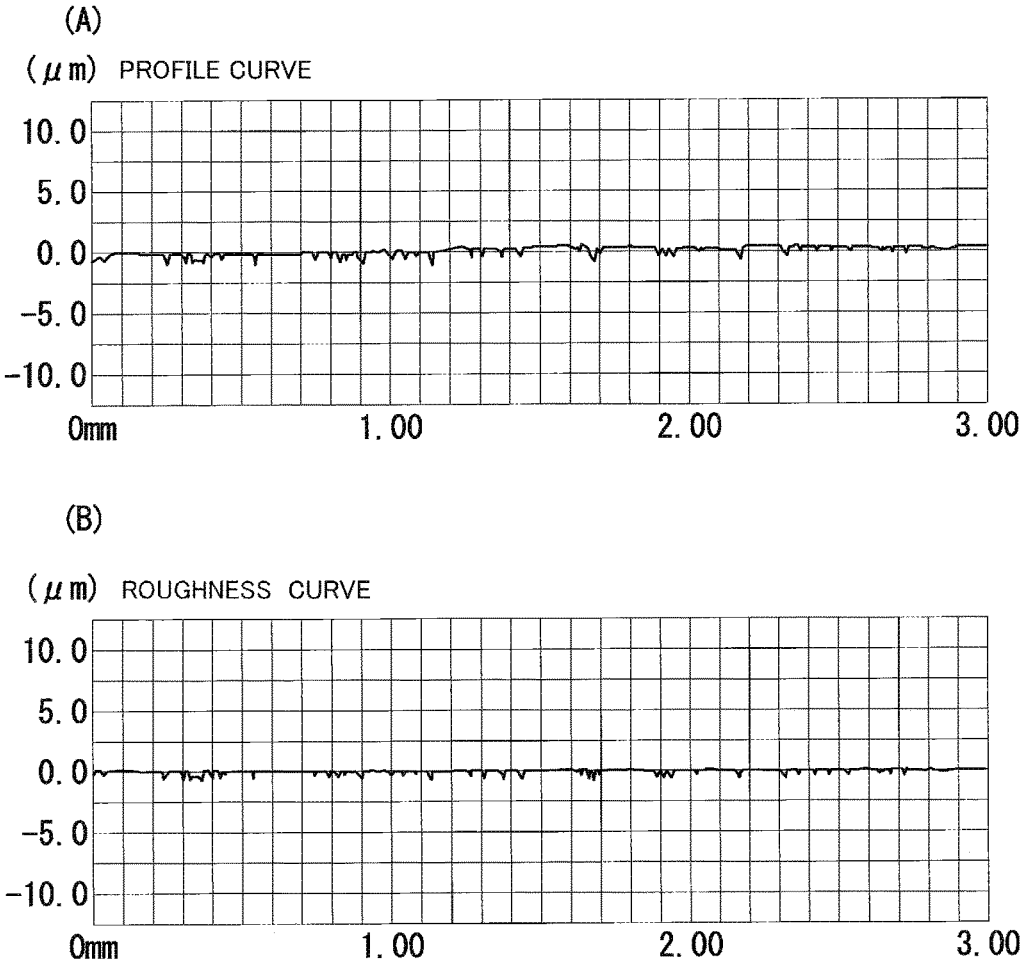
FIG. 4 Part (A) of FIG. 4 is a graph of a profile curve at an area molded with the die in a green compact No. 1 fabricated as a test example, and part (B) of FIG. 4 is a graph of a roughness curve at the area.
Figure 5:
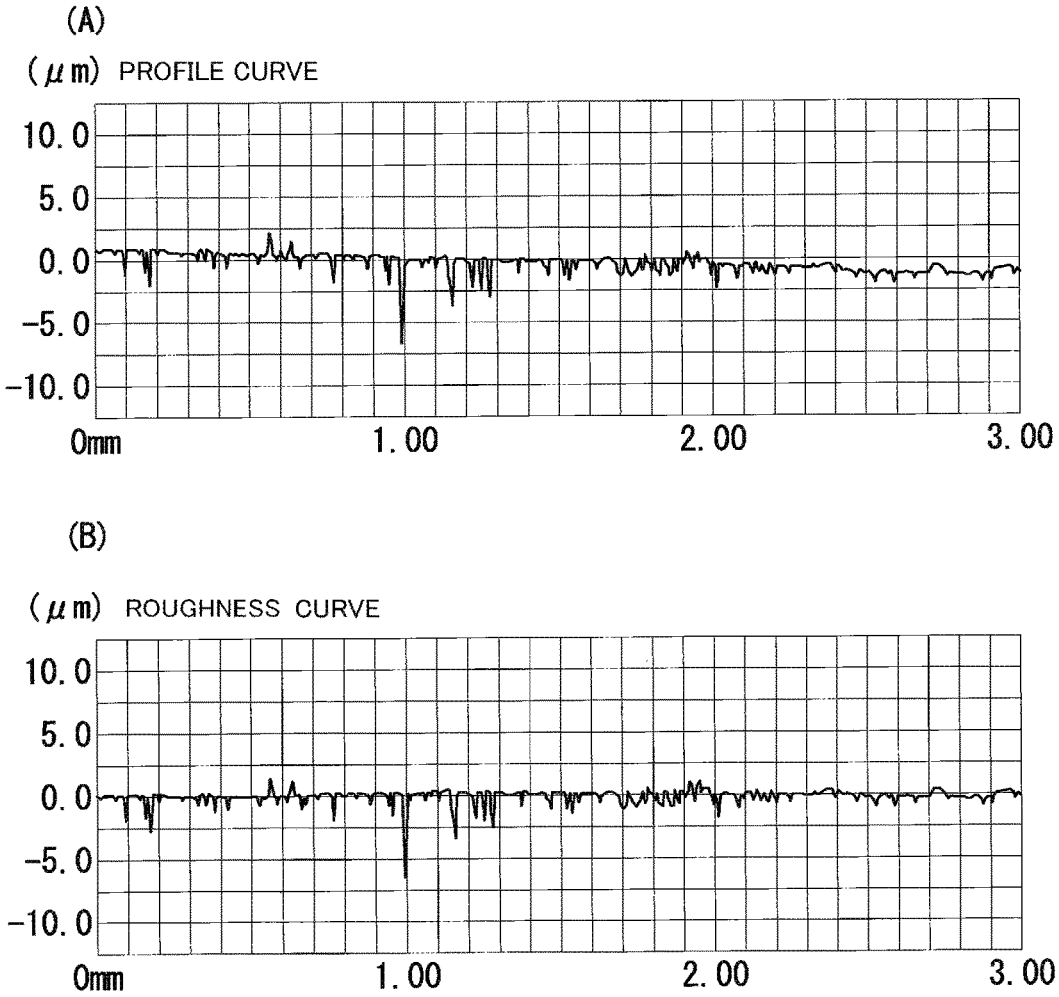
FIG. 5 Part (A) of FIG. 5 is a graph of a profile curve at an area molded with the core rod in the green compact No. 1 fabricated as a test example, and part (B) of FIG. 5 is a graph of a roughness curve at the area.
Figure 6:
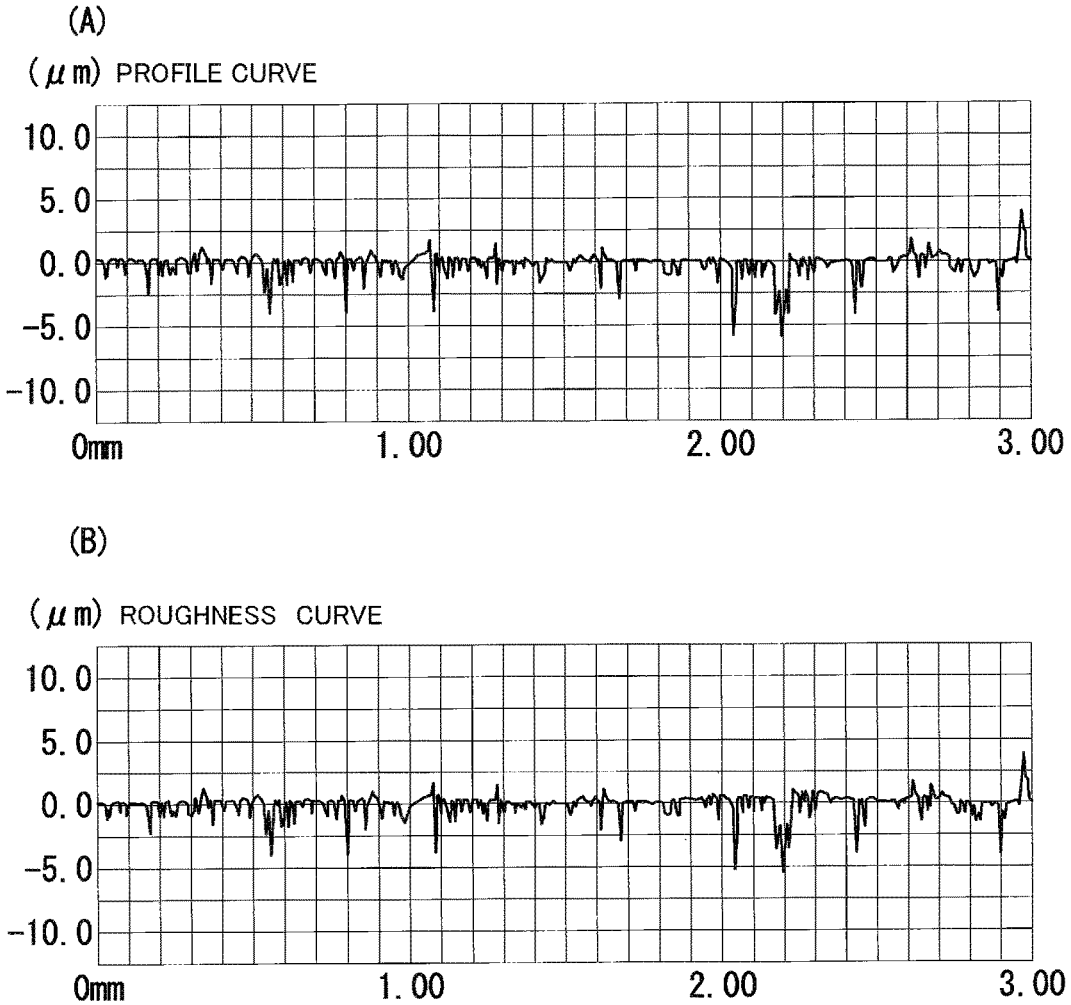
FIG. 6 Part (A) of FIG. 6 is a graph of a profile curve at an area molded with a punch in the green compact No. 1 fabricated as a test example, and part (B) of FIG. 6 is a graph of a roughness curve at the area.

FIGS. 4 to 6 illustrate profile curves and roughness curves of the areas. FIG. 4 illustrates a profile curve and a roughness curve in the area molded with the die, FIG. 5 illustrates a profile curve and a roughness curve in the area molded with the core rod, and FIG. 6 illustrates a profile curve and a roughness curve in the area molded with either the upper punch or the lower punch. FIGS. 4 to 6 each illustrate the measurement length ranging from 0 mm to 3.0 mm. Table II shows Ra, Rz, Rv, and Rpk in the areas. Table II also shows the ratio of a surface property value R2 of the area molded with the core rod to a surface property value R1 of the area molded with the die, which is R2/R1, and the ratio of a surface property value R(2) of the area molded with either the upper punch or the lower punch to the surface property value R1 of the area molded with the die, which is R(2)/R1.

TABLE II

| Surface Properties | Die R1 (μm) | Core rod R2 (μm) | Punch R(2) (μm) | Ratio R2/R1 | Ratio R(2)/R1 |
|---|---|---|---|---|---|
| Ra | 0.116 | 0.293 | 0.500 | 2.5 | 4.3 |
| Rz | 1.018 | 3.659 | 7.123 | 3.6 | 7.0 |
| Rv | 0.746 | 2.792 | 4.980 | 3.7 | 6.7 |
| Rpk | 0.067 | 0.240 | 0.741 | 3.6 | 11.1 |

As illustrated in FIGS. 4 to 6 and Table II, it is found that the surface property values in the area molded with the core rod are larger and rougher than those in the area molded with the die, and thus the area molded with the core rod is a relatively rough area. It is also found that, in the area molded with the core rod, at least one of the ratios relating to Ra, Rz, and Rv (all the three ratios, here) satisfies the condition of being 2 or more when the above-described surface property value ratios are obtained. From these findings and based on the results of observation using the microscope, an area (or may be a surface) in which the ratios relating to the surface property values Ra, Rz, and Rv satisfy the condition of being 2 or more can be considered to be an area in which insulating layers stay in a complete state. Furthermore, from these findings and the results of Table I, a low-loss core can be formed from a green compact including the above-described area.

It is also found that the peak height Rpk2 of the linear load curve in the area molded with the core rod is relatively small, and the ratio of the peak height Rpk2 to the peak height Rpk1 in the area molded with the die, which is Rpk2/Rpk1, is not larger than 5. This finding can be considered to be the basis for proving that a green compact having an area (or may be a surface) in which the ratio relating to the peak height Rpk satisfies the condition of being not larger than 5 has been manufactured using the above-described core rod. It can also be said that a green compact having been manufactured using the above-described core rod has the above-described insulating area without being separately subjected to a subsequent treatment.

As illustrated in FIGS. 4 to 6 and Table II, it is also found that the surface property values in the area molded with either the upper punch or the lower punch are larger and rougher than those in the area molded with the die, and thus the area molded with either the upper punch or the lower punch is a relatively rough area. It is also found that, in the area molded with either the upper punch or the lower punch, at least one of the ratios relating to Ra, Rz, and Rv (all the three ratios, here) satisfies the condition of being 2 or more when the above-described surface property value ratios are obtained. From these findings and based on the results of observation using the microscope, the following green compacts can be considered to be green compacts in each of which some insulating layers stay in a complete state: a green compact that has a surface including both a flat area (reference area) and an area in which the ratios relating to the surface property values Ra, Rz, and Rv satisfy the condition of being 2 or more; and a green compact that has three or more surfaces in which the ratios relating to the surface property values Ra, Rz, and Rv satisfy the condition of being 2 or more.

From the test results, it can be considered that a low-loss core can be formed from a green compact obtained by pressurizing a coated soft magnetic powder containing insulating layers, the green compact having a surface in which the ratio of the surface property value Ra, Rz, or Rv in an area appropriately selected from the surface to the surface property value Ra, Rz, or Rv in another area of the surface satisfies the condition of being 2 or more, or the green compact having three or more surfaces in which the ratio of the surface property value Ra, Rz, or Rv in an area selected from one surface to the surface property value Ra, Rz, or Rv in an area selected from another surface satisfies the condition of being 2 or more. Also from the test results, it can be considered that, when a green compact is manufactured by using a coated soft magnetic powder having insulating layers, by defining a compacting space with multiple die members and removing a green compact from the compacting space without moving at least one of the die members with respect to the green compact, a complete insulating layer can be maintained at a portion of the outer circumferential surface of the green compact and thus a low-loss core can be obtained from this green compact.

The present invention is not limited to the above-described embodiment, and can be changed as appropriate within a scope not departing from the gist of the invention. For example, a material or a particle diameter of soft magnetic particles, a material or a thickness of an insulating layer, the shape of an inner circumference of a die, the shape of an outer circumference of a core rod, the shape of a compacting space defined by a die and a core rod, and other conditions can be changed as needed.

Industrial Applicability

The green compact according to the present invention can be preferably utilized as a material for various cores (cores for a reactor, a transformer, a motor, and a choke coil), particularly, as a core that has an excellent high-frequency property. The method of manufacturing a green compact according to the present invention can be preferably utilized for manufacturing the green compact. The core for a reactor according to the present invention can be preferably utilized as a magnetic core for various reactors (for example, a vehicle-mounted component or a component equipped for an electric power station or substation). Particularly, a reactor including a reactor core according to the present invention can be preferably utilized as a component of a vehicle-mounted power converting device, such as a vehicle-mounted converter that is mounted on a vehicle such as a hybrid car, an electric car, and a fuel-cell electric vehicle.

REFERENCE SIGNS LIST

1A, 1B, 1C green compact
101 flat area
102 rough area
103, 105 rough surface
104 flat surface
100 compacting die set
10A, 10B, 10C, 10D, 10E die
10$h_A$, 10$h_B$, 10$h_C$, 10$h_D$, 10$h_E$ through hole
10$u$ top surface
11 upper punch

11*d* pressing surface
12 lower punch
12*u* pressing surface
13A, 13B, 13C, 13D, 13E core rod
13*u* top surface
14 moving mechanism
21A, 22A, 21B, 22B, 23B, 24B, 21C, 22C, 23C, 24C, 25C, 26C, 21E space
31, 32 compacting space
41, 42 green compact
P raw-material powder

The invention claimed is:

1. A method of manufacturing a green compact, the method comprising:

a filling step of filling a compacting space with an insulated coated soft magnetic powder, the compacting space being defined by a die that has a through hole with which a part of the outer surface of the green compact is molded by the through hole, a core rod with which another part of the outer surface of the green compact is molded, and a first punch disposed so as to cover one of opening portions of the through hole, the core rod being inserted and disposed in a space of the through hole, and the core rod being penetrated through the first punch wherein the insulation of the insulated coated soft magnetic powder insulates the soft magnetic powder from a conduction of electrical current;

a pressurizing step of pressurizing the coated soft magnetic powder in the compacting space using the first punch and a second punch disposed so as to face the first punch, and a removing step of removing a green compact from the die, said green compact having been obtained after pressurizing the coated soft magnetic powder, from the compacting space by moving the die with respect to the formed green compact without moving the core rod with respect to the formed green compact, wherein a surface of the through hole of the die contacts with an outer surface of the core rod, excluding end faces of the core rod.

2. The method of manufacturing a green compact according to claim 1, wherein in the pressurizing step, the coated soft magnetic powder is pressurized by moving the second punch while the first punch is fixed, and the die and the core rod are moved together with the moving of the second punch.

3. The method of manufacturing a green compact according to claim 1, wherein a plurality of green compacts are formed at the same time by defining a plurality of compacting spaces, in which the plurality of green compacts are formable, by a plurality of die members.

4. The method of manufacturing a green compact according to claim 1, wherein the compacting space is rectangular and is formed by the through hole of the die and the outer surface of the core rod, excluding end faces of the core rod.

* * * * *